US005429365A

United States Patent [19]

McKeighen

[11] Patent Number: 5,429,365

[45] Date of Patent: Jul. 4, 1995

[54] TITANIUM GOLF CLUB HEAD AND METHOD

[76] Inventor: James F. McKeighen, 1293 Calma Ct., Vista, Calif. 92083

[21] Appl. No.: 106,933

[22] Filed: Aug. 13, 1993

[51] Int. Cl.[6] ..... A63B 53/04; B22C 9/00

[52] U.S. Cl. ..... 273/173; 273/167 H; 273/167 J; 164/369

[58] Field of Search ... 273/167 R, 77 R, 167 F–167 J, 273/169, 170, 171, 172, 173, 174, 175, 80.1, 80.2, 167 A, 80.7; 249/63; 29/527.5; 164/369

[56] References Cited

U.S. PATENT DOCUMENTS

| | | | |
|---|---|---|---|
| 3,759,517 | 9/1973 | Mills | 273/80.7 |
| 4,021,047 | 5/1977 | Mader | 273/167 H |
| 4,417,731 | 11/1983 | Yamada | 273/167 H |
| 4,429,879 | 2/1984 | Schmidt | 273/167 H |
| 4,432,549 | 2/1984 | Zebelean | 273/167 H |
| 4,438,931 | 3/1984 | Motomiya | 273/80.2 |
| 4,472,092 | 9/1984 | Schmidt | 273/167 H |
| 4,489,945 | 12/1984 | Kobayashi | 273/172 |
| 4,602,787 | 7/1986 | Sugioka | 273/167 H |
| 4,877,249 | 10/1989 | Thompson | 273/169 |
| 5,028,049 | 7/1991 | McKeighen | 273/167 J |
| 5,042,806 | 8/1991 | Helmstetter | 273/167 K |
| 5,090,702 | 2/1992 | Viste | 273/167 H |
| 5,094,383 | 3/1992 | Anderson | 273/167 H |
| 5,205,560 | 4/1993 | Hoshi | 273/78 |
| 5,232,224 | 8/1993 | Zeider | 273/167 H |
| 5,255,913 | 10/1993 | Tsuchida | 273/78 |
| 5,295,689 | 3/1994 | Lundberg | 273/167 H |

FOREIGN PATENT DOCUMENTS

| | | | |
|---|---|---|---|
| 2581320 | 11/1986 | France | 273/171 |
| 404367678 | 12/1992 | Japan | 273/167 H |
| 405076624 | 3/1993 | Japan | 273/167 H |
| 2230459 | 10/1990 | United Kingdom | 273/167 H |

*Primary Examiner*—Sebastiano Passaniti

*Attorney, Agent, or Firm*—Harness, Dickey & Pierce

[57] ABSTRACT

A golf club head and method of manufacture in which the golf club head comprises a body having a striking face, side walls, a neck portion and a heel and toe portion formed as an integral unit, said golf club body being attached to a top plate by screwing, gluing or welding wherein the top plate can be constructed of a material different than said body. When the top plate is attached to the body via a screw then a support wedge is formed behind said striking face extending down to the sole plate for structural support of said striking face. The method of the invention involves removal of the inner core forming the interior chamber of said body through the top of said golf club head, said inner core being removable in a single piece from the top portion of the wax impression that is used to manufacture a metal golf club head.

10 Claims, 4 Drawing Sheets

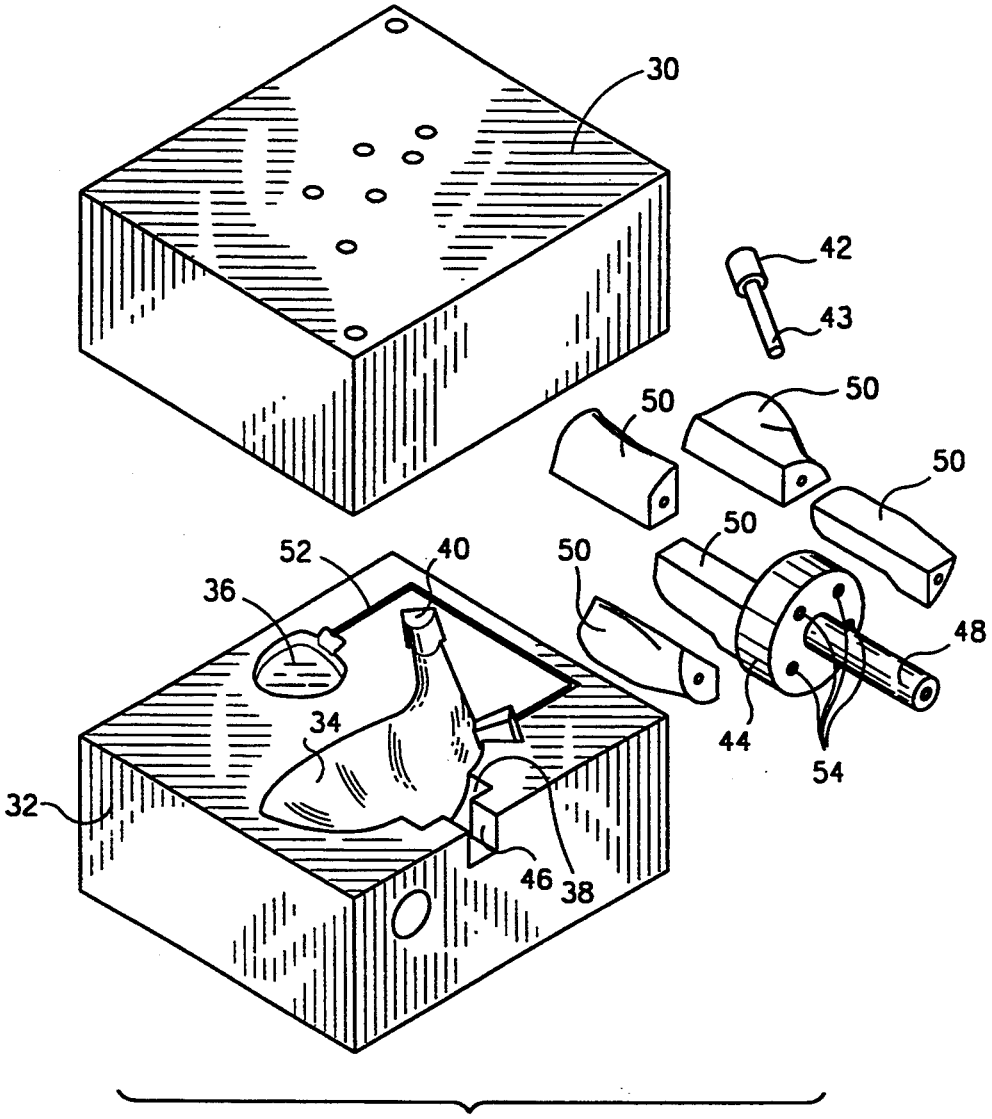
FIG. 5
PRIOR ART
FIG. 6
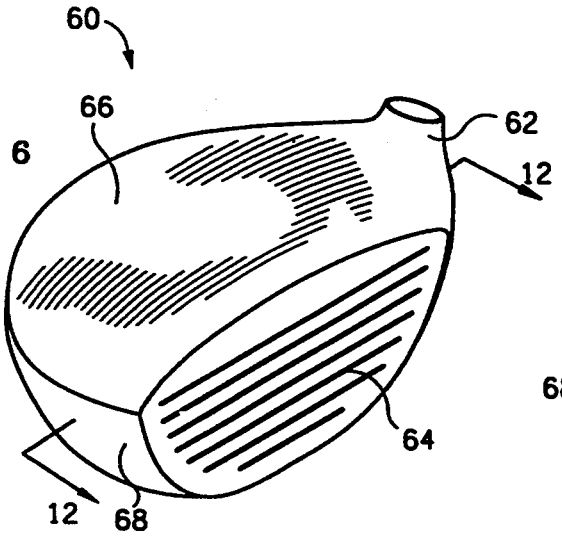
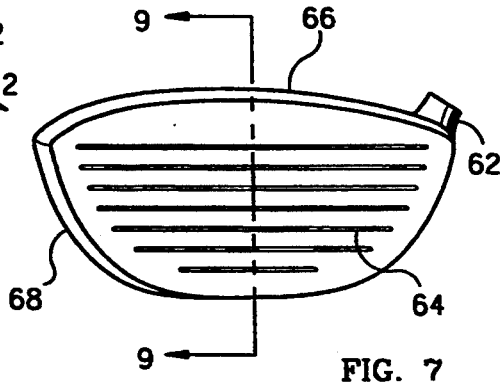
FIG. 7

TITANIUM GOLF CLUB HEAD AND METHOD

BACKGROUND OF THE INVENTION

Metal golf club heads have been successfully manufactured and marketed for many years. The manufacture of these golf club heads typically involves casting the striking face, the side walls, the top of the club head and the hozzle as one unit and then casting simultaneously a sole plate as another piece. The sole plate is then welded to the main body of the golf club head and the whole head is polished and prepared for attachment to a golf shaft. In the process of casting the golf club head and sole plate, the lost wax method is typically used in which a mold is made that conforms to the outside of the golf club head and a core is made which conforms to the inside wall of the golf club head. After the mold is formed, usually in two pieces, a wax impression of the golf club head is formed in the mold. When the two piece mold is separated, the inner core is removed from the golf club head by disassembling the core and by removing the core piece-by-piece and by reassembling the core and replacing it in the mold. The inner core must be disassembled before removal because the core is much larger than the sole plate opening through which it is removed. It takes approximately 5 to 8 minutes to remove the wax impression of the golf club head from the mold and to remove the core from the wax impression and then reassemble it. After the wax impression is made it is coated with ceramic material in a standard fashion and is then heated to remove the wax. After the wax is removed then the molten metal is poured or injected into the ceramic mold which produces the golf club head. The weight of the golf club head is important in that it should be from approximately 200 to 215 grams total head weight. Weights above this amount are undesirable in that they are too heavy and do not produce a good "feel" for swinging the golf club. This weight constriction limits the amount of weight that can be placed in the heel and toe of a steel golf club head because the material is necessary in other places such as the side walls, the top of the golf club head and the hozzle for structural stability and durability. This means that a lot of the weight of a steel golf club head is distributed throughout the club head and cannot be as concentrated in the heel and the toe and the sole plate which would be ideal. Also, the weight limitation for the golf club head limits the designer's ability to increase the size of the striking face, thereby increasing the size of the sweet spot of the striking face. If the size of the sweet spot is increased, then the chances of hitting the ball straight when the ball is mis-hit increases.

Therefore, it would be desirable to make a golf club head out of the material that allowed more weight to be placed in the heel and the toe of the striking face as well as the sole plate and to make this club head by a method that reduces the amount of time necessary to make the wax impression of the golf club head that is in turn used to make the mold in which the metal head is cast.

SUMMARY OF THE INVENTION

The present invention is a novel method for casting a golf club head which significantly reduces the amount of machine time, labor and time necessary to make a wax impression that is used to make the mold for casting the golf club head.

The second aspect of the invention involves the use of titanium for casting the golf club head which allows better distribution of weight in the heel, toe and sole of the golf club head. Also, the hozzle of the golf club head is mostly contained within the body of the golf club head thereby placing more weight towards the bottom and heel of the golf club head which in turn provides for better weight distribution. In the preferred embodiment of the invention the thickness of the striking face is thinner at the middle and is thicker towards the heel and the toe of the striking face and the sole plate. This lowers the center of gravity and moves it closer to the striking face. The use of titanium allows this concentration of weight in the heel and the toe of the striking face and the sole plate which is ideal.

Another aspect of the present invention involves used of a mold in which the core used to make the wax impression is removed from the top portion of the golf club head. The top plate of the golf club head is mated to the main body via locating grooves and is screwed down to the sole plate by using a cylindrical extension of the top plate that is screwed to a portion of the sole plate. This eliminates the welding step which is one of the more expensive steps in the manufacture of a titanium golf club head. This does not preclude welding if a more rigid structure is desired. Epoxying the parts is a third alternative as is any combination of the above methods.

Another aspect of the present invention involves the use of a triangular-shaped wedge that is placed in the center of the back side of the striking face of the golf club head and runs vertically from almost the top of the striking face to the sole plate. The purpose of this wedge is to give greater structural integrity to the striking face of a club having a screwed on top plate. This also allows the distribution of more weight to the heel and the toe of the club head and substantially reduces the resonance sometimes produced at impact by a hollow head.

Therefore, it is an object of the present invention to provide an improved method for making wax impressions for golf club heads by reducing the amount of machine time, labor and time necessary to make the wax impression.

Another object of the present invention, and produce a more efficient head at the same time, is to make a golf club head with a neck located mostly inside the golf club head and with improved weight distribution wherein the weight is shifted to the heel and the toe of the striking face.

A further object of the invention is to provide a titanium golf club head with improved resonance suppression and with improved structural integrity of the striking face which in turn allows even more weight to be distributed to the heel and the toe of the golf club head.

BRIEF DESCRIPTION OF THE DRAWINGS

FIG. 5 is a prospective view of a two-piece mold and the associated core for making prior art wax impressions.

FIG. 6 is prospective view of the golf club head of the present invention.

FIG. 7 is a front view of the golf club head of the present invention.

DESCRIPTION OF THE PREFERRED EMBODIMENT

Figure 1:
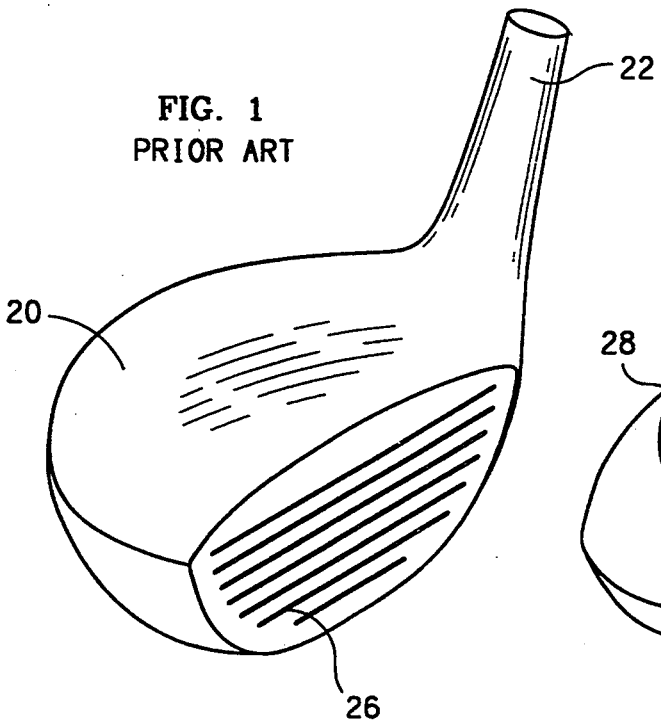
FIG. 1 PRIOR ART
FIG. 1 is a prospective view of a prior art metal golf club head.
Figure 2:
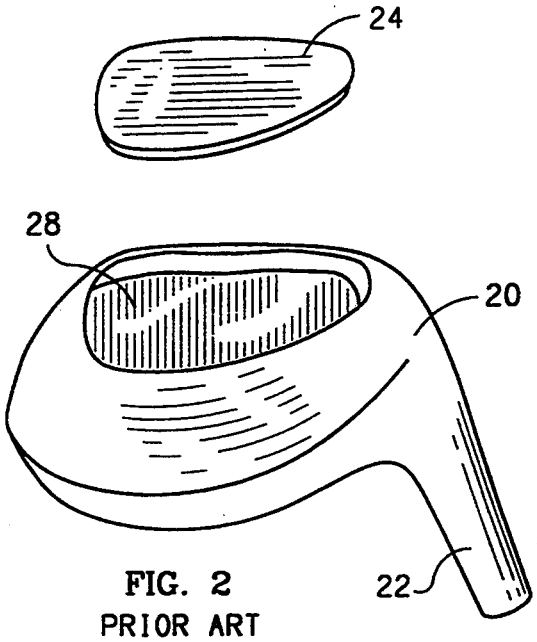
FIG. 2 PRIOR ART
FIG. 2 is a prior art showing the manner in which a golf club head is cast and the manner in which the sole plate is welded to the golf club head.
Figure 3:
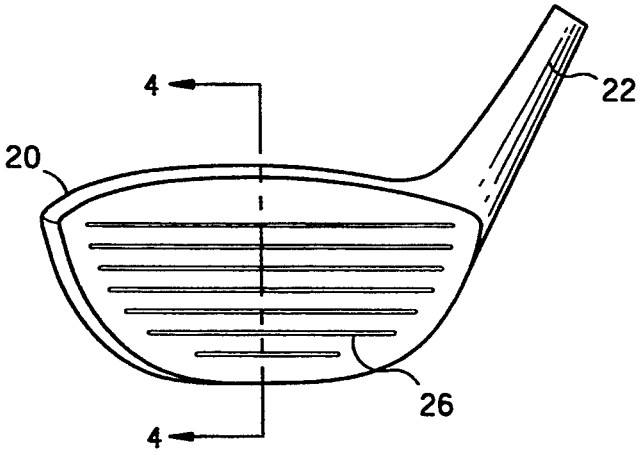
FIG. 3 PRIOR ART
FIG. 3 is a front view of a prior art golf club head.
Figure 4:
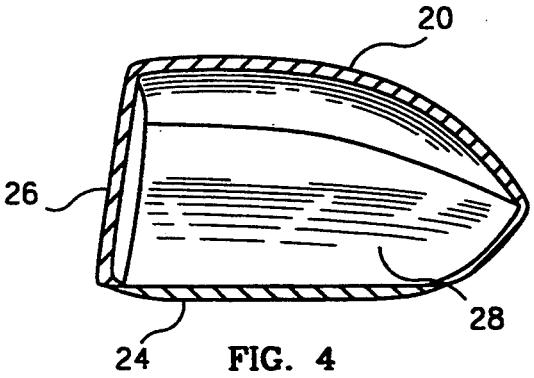
FIG. 4 PRIOR ART
FIG. 4 is a side cross-section view of a prior art golf club along section lines 4 of FIG. 3.

FIGS. 1 through 4 are prior art drawings of a metallic golf club head that can be made of steel or it can be made of titanium as disclosed in U.S. Pat. No. 5,028,049 issued to James F. McKeighen on Jul. 2, 1991. As disclosed in that patent, the striking face 26 of the golf club head 20 is thinnest at the center of the striking face 26 and is thicker around the entire periphery of the striking face. The golf club head also has a hollow neck 22 that extends upward from the body of the golf club head 20 which is used as a means of attaching the golf club head to a golf shaft (not shown). FIG. 2 shows the golf club head 20 upside down with the sole plate 24 shown before it is welded to the golf club head 20. Typically the golf club head 20, whether it is made from titanium, titanium alloy or steel is cast as one piece comprising of the body 20, the striking face 26 and the neck 22. The sole plate 24 is typically cast separately at the same time as the main body 20 of the golf club head. The sole plate 24 is then welded to the body 20. FIG. 3 is a front view of the golf club head 20 showing the striking face 26 and the neck 22. FIG. 4 is a side-section view showing the striking face 26, the main body 20 and the interior cavity 28 of the golf club head. The interior of cavity 28 is typically filled with some dampening material such as foam to reduce the resonance that is sometimes produced when the golf club head strikes a golf ball. The addition of the foam to the golf club head adds weight that is evenly distributed throughout the interior cavity 28 of the golf club head 20. The ideal weight for a golf club head driver is generally recognized as being between 200 and 215 grams total weight. It would be better if the additional weight from the foam were concentrated in the heel and toe of the striking face. However, this is not possible because the foam must fill most of the cavity to be effective.

FIG. 5 shows a typical mold that is used to make a wax impression which in turn is used to make a mold in which a metal golf club head is cast. In the typical mold, there is an upper mold 30 and a lower mold 32. In a standard operation for making a wax impression, an inner core 50, which corresponds to the inner cavity 28 shown in FIG. 4, is assembled by screwing the various core pieces 50 to the mandrel 44 and inserting the assembled inner core 50 into the mold with the mandrel 44 resting in the area 38 and the mandrel neck 48 resting in slot 46 and protruding therefrom. The inner core 50 rests inside the cavity 34. To form the hollow neck portion, neck pin 42 rests in neck cavity 40 and the end 43 of the neck pin 42 rests against a portion of the inner core 50. The upper mold 30 is then combined with the lower mold 32 in a press and wax is injected via line 52 to form the sole plate in cavity 36 and the golf club head, minus the sole plate, in cavity 34. After the wax is injected, the upper portion of the mold 30 is separated from the lower portion of the mold 32 and the wax impression is removed from the lower mold by removing mandrel 44 by its neck 48. Next, the inner core 50 is removed from the inner cavity of the wax impression by removing screws 54 and then removing the inner core 50 one piece at a time. It is necessary to remove the inner core 50 one piece at a time because the inner core is much larger than the sole plate opening through which the inner core 50 is removed. This process takes approximately 5 to 8 minutes and adds unwanted labor costs to the process of making a wax impression used to manufacture a metal golf club head.

FIGS. 6 and 7 respectively show a perspective view and a front view of a cast golf club head 60 showing part of the present invention. The golf club head 60 has a neck portion 62 which extends into the interior of the golf club head 60. The golf club 60 has a striking face 64, side walls 68 and top 66. The purpose of lowering the neck so that it is now mostly inside the golf club head is to lower the center of gravity of the golf club head and add weight to the heel thereby improving the playing characteristics of the golf head by raising the launch angle.

Figure 8:
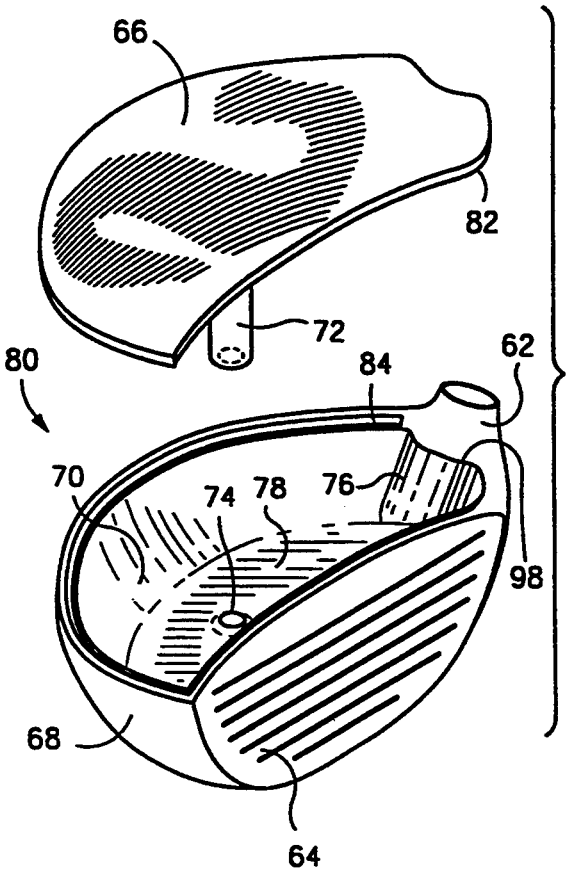
FIG. 8 is a prospective view of the present invention with the top plate of the golf club head removed.
Figure 9:
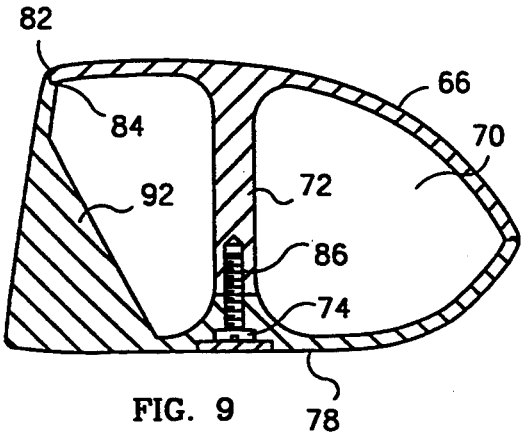
FIG. 9 is a side cut-away view showing one method by which the top plate is attached to the body of the golf club head.
Figure 10:
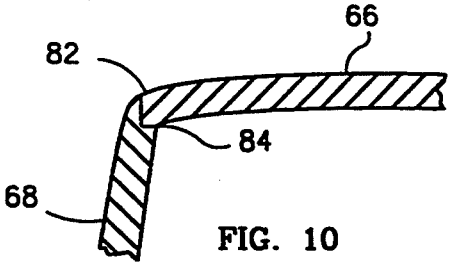
FIG. 10 shows the manner in which the top portion of the golf club head is connected to the body of the golf club head.

FIG. 8 is a prospective break away view of the golf club head of the present invention showing that the present golf club head is cast in two pieces. The first piece or lower body 80 comprises the striking face 64, side walls 68, neck portion 62, the neck cavity 76 and the sole plate 78. The second portion comprises the top plate 66 having an attachment means 72 protruding from the bottom side of the top plate 66. The top plate 66 of the golf club head can be cast at the same time as the lower body 80. The sole plate 78 has a screw hole 74 in which a screw is inserted through screw hole 74 and screwed into attachment means 72. This connection is better shown in FIG. 9 which shows top portion 66 connected to the sole plate 78 by screw 86 protruding through screw hole 74 into the attachment means 72. FIG. 10 is an enlarged view showing the fit between the side walls 68, the striking face 64 and the top plate 66. As can be seen, the edge 82 of top plate 66 fits into groove 84 which has been cast into the side walls 68 and striking face 64 of the lower body 80. By screwing the top plate 66 to the lower body 80, the welding step can be eliminated thus providing significant cost savings over previous methods of manufacturing metallic golf club heads. Also, the top plate 66 can be manufactured from materials different from the material used to manufacture the lower body 80. For instance, the lower body 80 could be made of steel and the upper plate 66 can be made of titanium, aluminum or a composite material such as graphite which would allow more of the weight to be concentrated in the heel, toe and sole plate of the golf club thereby improving the playing characteristics of the golf club head by raising the launch angle. It is important to note that this embodiment of the invention shows that the welding step can be eliminated by screwing the top plate 66 to the lower body 80. However, if a more rigid structure is desirable for the type of material being used then the top plate 66 can be welded to the lower body 80 in a standard manner such as the manner in which the sole plate is currently welded to the golf club head. It can also be glued or epoxied to the lower body 80.

Another aspect of the present invention involves casting the lower body 80, including the sole plate 78, as one piece. As shown in FIG. 9, the interior portion 70 of lower body 80 is the same size or smaller than the dimensions of the lower body 80 at the upper edge of side walls 68 and striking face 64. Also, the side wall of the neck chamber 76 (FIG. 8) is flush with the neck periphery edge 98 which also has groove 84. This allows an inner core to be removed as one piece thereby eliminating much of the labor, expense and machine time associated with making a wax impression for a metal golf club head. This aspect of the invention, forming the lower body 80 as one piece and removing the inner core from the top of the golf club head, will be discussed further in connection with FIG. 14.

Figure 11:
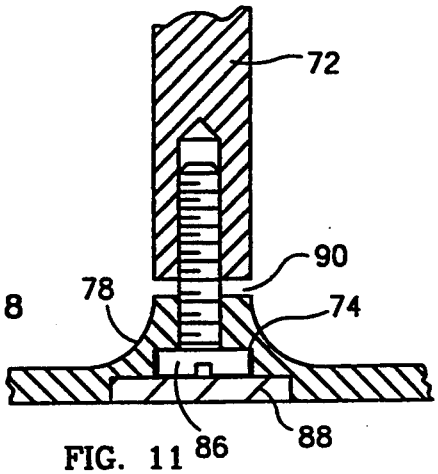
FIG. 11 shows the junction where the top plate of the golf club head is screwed to the sole plate.
Figure 12:
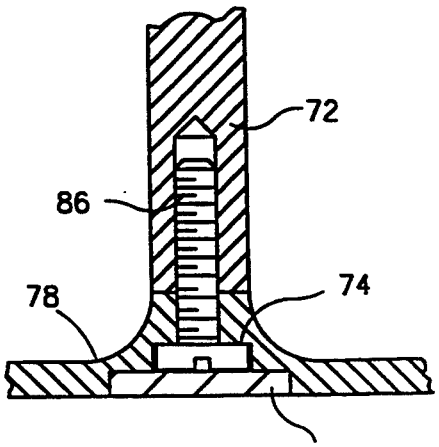
FIG. 12 is an enlarged view of the manner in which the top plate is secured to the sole plate.

Another aspect of the invention is shown in FIGS. 11 and 12 which are expanded views of the top plate 66 connected to the sole plate 78 via the screw 86 and attachment means 72. FIG. 11 shows the screw 86 inserted in screw hole 74 and connected to attachment means 72. FIG. 11 also shows gap 90 which is approximately 0.020 of an inch. When the top plate 66 is inserted onto the lower body 80, the gap 90 exists until the screw 86 is tightened. By closing this gap with tension from the screw, the top plate 66 is held firmly in place. FIG. 12 shows the same view as in FIG. 11 except that gap 90 has been closed by applying tension by the screw 86. Also, as shown in FIGS. 11 and 12, there is an area 88 in sole plate 78 that can be used for placement of an insert. This insert can serve two functions which are to cover the screw 86 from view and to identify the logo or trademark of a particular golf club manufacturer. It should be noted that a golf club head can be manufactured without attachment means 72 and screw hole 74. In this method of manufacture, the top plate 66 would still be molded in the same fashion except that instead of screwing the top plate 66 to the sole plate 78, the top plate 66 would be welded or epoxied to the side walls 68 along its periphery and the striking face 64. Welding has a disadvantage of being more costly, however, it has the advantages of eliminating attachment means 72 which means that more material can be used to provide weighting in the heel and toe in the golf club head 80 and it provides a more rigid structure.

Figure 13:
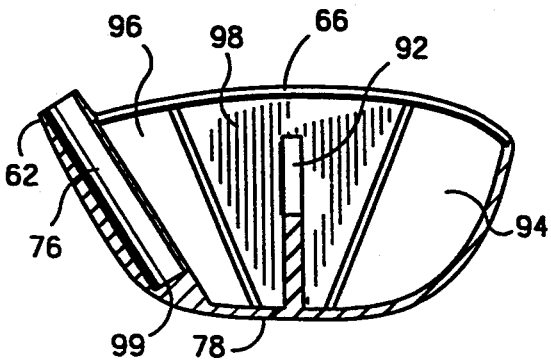
FIG. 13 is a cut-away view of the back of the striking face showing the support wedge and the thickened areas.

FIGS. 9 and 13 show other novel aspects of the present invention. First, FIG. 9 shows a wedge 92 that is molded into the lower body 80 of the golf club head. FIG. 9 shows a side view of the wedge 92 and FIG. 13 shows a rear view of the striking face and the location of the wedge 92. The wedge 92 extends from the back of the striking face 64 down to the sole plate. The purpose of the wedge is two fold. It provides structural integrity to the front striking face when the top plate 66 is screwed to the sole plate 78 and it allows more of the metal to be used for weighting in the heel and toe because it dampens the clanking sound that is made when a metal driver strikes a golf ball and eliminates the need to use foam. FIG. 13 also shows areas 94, 96 and 98 on the back of the striking face 64. Areas 94 and 96 are thicker (typically 0.200" to 0.350' if titanium is used) and area 98 is thinner (typically 0.100" to 0.180" if titanium is used). This weighting arrangement adds weight to the heel area 96 and to the toe area 94. This expands the sweet spot in all directions so that when a ball is mis-hit either on the heel or the toe of the golf club head the ball will go straighter. The present design has the largest sweet spot of any metal head that can be manufactured. Another aspect of the invention is lowering the neck cavity 76 into the interior cavity of the golf club head 80. FIG. 13 shows that only a small portion of the neck 62 is outside of the interior of the golf club head 80. This takes weight from where the neck used to be and places it down inside of the golf club cavity thereby lowering the center of gravity and adding desired weight to the heel area 96 of the golf club. As shown in FIG. 12, the added weight areas 94 and 96 extend from the top plate 66 of the golf club head all the way to the sole plate 78. Also, the thinner area of the striking face 98 also extends from the top plate 66 of the golf club head to the sole plate 78. By eliminating peripheral weighting that extends around the entire perimeter of the striking face, more weight can be added to the heel area 96 and the toe area 94 thereby improving the weighting characteristics of the golf club head.

Another aspect of the invention is shown in FIG. 13 wherein the neck cavity 76 does not extend all the way through the sole plate 78 but stops at the blind bottom end 99 of the blind bottom neck cavity 76. It should be noted that the neck cavity 76 has been shortened to approximately 1.25 inches which improves the weighting characteristics of the golf club head without sacrificing the integrity of the connection between the golf club head and the golf shaft. The neck cavity 76 can also extend all the way through the sole plate 78 if desired. However, this adds additional labor costs in that the connection between the golf shaft and the sole plate must be machined and dressed so that the sole plate of the golf club head has a suitable appearance. It is much more efficient to use a blind bottom neck cavity 76 as shown in FIG. 13.

The top portion 66 does not necessary have to be made of the same material as the lower body 80. The top portion 66 can be made of almost any metal capable of being cast or it can be made of composites such as boron or graphite fiber composites. By making the top portion out of a composite, even more weight can be eliminated from the top 66 and consequently more weight can be concentrated in the heel, the toe and the sole plate. One aspect of the present invention, the top plate 66 and the lower body 80 are both made of titanium which allows more metal to be used for proper weighting in the heel and toe of the striking face than if, for instance, steel was used. If the lower body is fabricated of steel then significant weight savings could be achieved by constructing the top plate 66 out of titanium, aluminum or a composite material. If the top plate is welded or epoxied to the lower body, then the support wedge 92 could be eliminated along with the screw hole 74 in sole plate 78 and the attachment means 72 connected to the top plate 66. Thus, various combinations of materials can be used to construct the golf club head according to the ideal strength and weighting objectives.

The method of casting in which the core is drawn out through the top of the golf club head is applicable to any type of metal or composite head, or combination thereof that can be cast. The other detailed aspects of the new casting process are shown with reference to FIG. 14.

Figure 14:
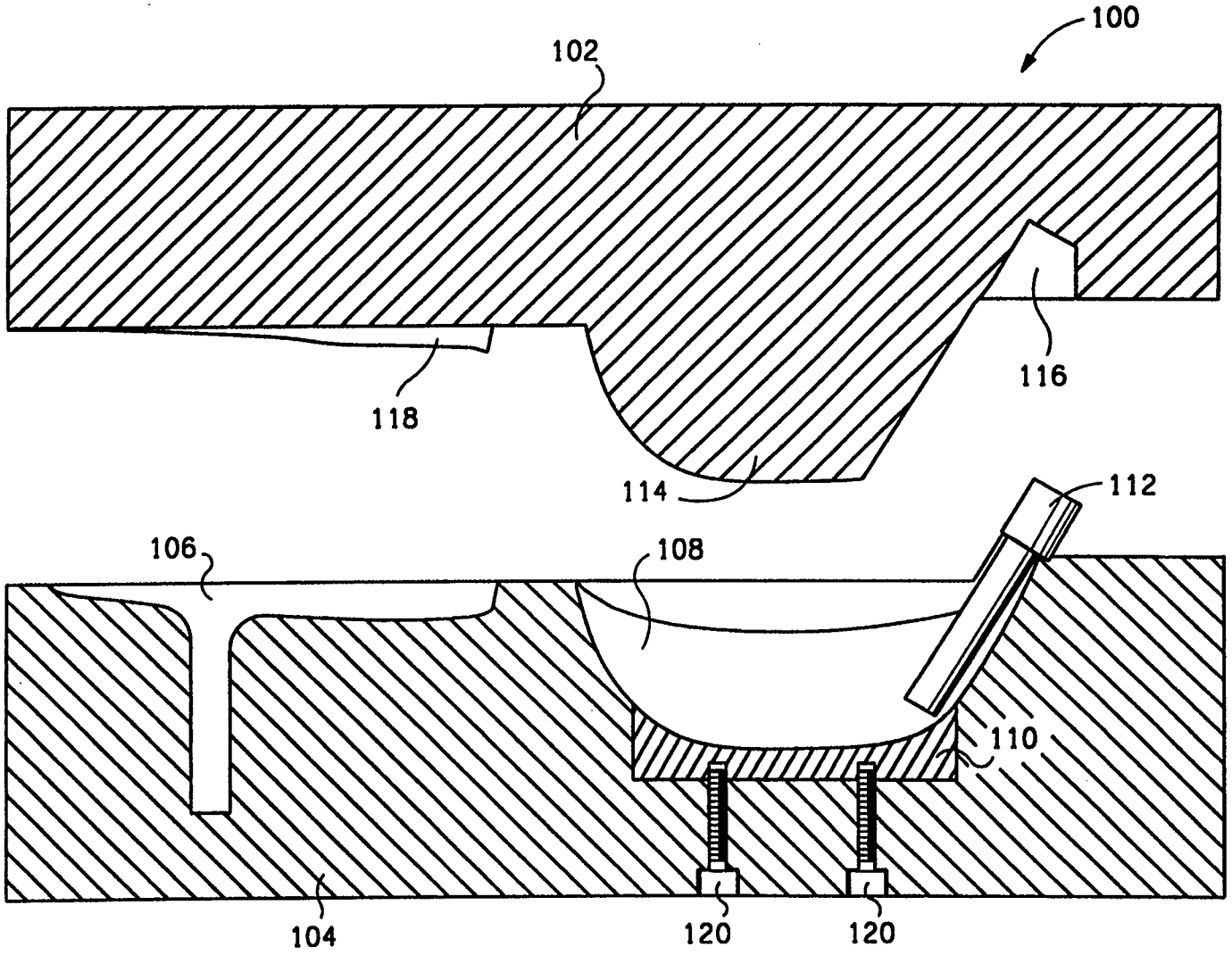
FIG. 14 is a side cut-away view of a two-piece mold for simultaneously molding the top plate and the main body of the golf club head and showing a removable insert for varying the design of the sole plate.

FIG. 14 shows a two-piece mold 100 suitable for practicing the method of the present invention. In this molding process, there is used a top portion 102 of the mold and a bottom portion 104 of the mold 100. The mold 100 has a cavity 106 for casting the top plate 66 and a top portion 118 of the mold 102 is also used for casting the top plate 66. The bottom portion 104 also has a cavity 108 for casting the main body of the golf club head. As shown in FIG. 14, the lower portion 104 of the mold 100 also has a removable sole plate mold insert 110 which is held in place by screws 120. The purpose of this removable insert is so that various designs for the sole plate can be cast by only making changes to the sole plate mold insert 110. For example, if a heavier sole plate was desired, when titanium is being used, a different sole plate mold insert 110 can be used that allowed for more metal to be cast in the sole plate of the golf club head. Also, different designs and logos or trademarks can easily be cast into the sole plate of the wax impression so that the same mold, with different sole plate mold inserts, can be used for many different manufacturers. The mold 100 also shows that a neck pin 112 is inserted in the lower portion 104 of the mold 100 to provide for the blind bottom hole or cavity 76 shown in FIG. 13. Area 116 in the upper portion 102 of the mold 100, is designed to lift cleanly and freely from the lower portion and the core 114 is removed cleanly and freely from the inner cavity 108 (without disassembly of the core 114) thereby significantly reducing machine time, labor and cost of making the wax impressions. This significant reduction in overall cost is applicable to heads made of titanium, titanium alloys, steel and combinations of other metals or composites which have been used to fabricate golf club heads.

While the main discussion above has been concentrated on drivers, the method and structures discussed above apply to all golf clubs of the "wood" varieties.

While the preferred embodiment of the system and method of the present invention has been illustrated and described, certain modifications and alternatives will be apparent to those skilled in the art and the present disclosure is intended to include such modifications and alternatives within the scope of the appended claims.

What is claimed is:

1. A golf club head comprising:

a hollow body including a first cast portion having a front striking face, a sole plate, curved side walls, a heel, a toe and an integral hollow neck extending upwardly from the heel of said first portion for attaching said golf club head to a shaft; and a second portion in the form of a top plate that is separately attached to said first cast portion of the golf club head wherein said top plate includes a bottom side having a downwardly extending attachment means for assisting in maintaining a connection between said first and second portions of said body, and at least one fastener extending from said sole plate of said first portion for engaging the attachment means of said top plate to thereby maintain a connection between said first and second portions inserted.

2. The golf club head of claim 1, wherein an inner surface of said first portion includes a wedge attached to both the striking face and the sole plate and terminating at the top plate for reinforcing the striking face.

3. The golf club head of claim 2, wherein said striking face includes thicker portions at the heel and toe and a thinner portion at the center, said thinner portion occurring between the top plate and sole plate of said golf club head.

4. A golf club head comprising:

a hollow body including a first portion having a front striking face, a sole plate, curved side walls, a heel, a toe and an integral hollow neck extending upwardly from the heel of said first portion for attaching said golf club head to a shaft, said neck being contained at least partially inside said body and includes a blind bottom hole;

a second portion in the form of a separately attached top plate, said top plate including a bottom side having a downwardly extending attachment means for maintaining a connection between said first and second portion of said body; and a fastener extending from the sole plate of said portion to engage the attachment means of said second portion thereby maintaining a connection therebetween.

5. A method of molding a wax impression useful for manufacturing an at least partially cast golf club head comprising the steps of:

forming a wax impression having a hollow body portion including a sole plate, side walls, a striking face, a neck formed as an integral piece and an opening located along a top portion of said body portion within a mold including a mold cavity by disposing a one piece inner core corresponding to the inside dimensions of the body portion in the mold cavity and introducing a sufficient amount of wax into the mold cavity, and thereafter removing the one piece inner core from the interior of said body through said opening 6. A golf club head comprising:

a hollow body including a cast first portion having a front striking face, a sole plate, curved side walls, a heel, a toe and an integral hollow neck extending upwardly from the heel of said first portion for attaching said golf club head to a shaft;

a second portion in the form of a separately attached top plate including a bottom side having a downwardly extending attachment means for assisting in maintaining a connection between said first and second portions of said body; and at least one fastener extending from the sole plate for engaging said attachment means, said first portion having a wedge attached to said striking face and attached to said sole plate for reinforcing the striking face.

7. A method of forming an impression having a hollow body portion for subsequently casting at least a portion of a golf club head, comprising the steps of:

(a) disposing a one piece inner core in a suspended position within the mold cavity of a mold and thereafter closing the mold; and (b) introducing a substance which subsequently solidifies in the mold cavity to form an impression having the overall shape of a golf club head portion including a sole plate, side walls, striking face and neck, with an aperture provided along the top portion thereof such that upon forming the impression and opening the mold the one piece inner core can be removed from the impression through said aperture as one piece.

8. The method of claim 7, comprising the further step of casting a golf club head body portion including the sole plate, side walls, striking face and neck with an aperture provided along the top portion utilizing said impression and thereafter attaching a top plate to said golf club head portion substantially covering said aperture.

9. The method of claim 8, wherein said golf club head body portion is cast titanium or a titanium alloy.

10. The method of claim 8, wherein the top plate is constructed of titanium or titanium alloy.

* * * * *